US007992604B1

(12) United States Patent
Suor et al.

(10) Patent No.: US 7,992,604 B1
(45) Date of Patent: Aug. 9, 2011

(54) RIPSAW STABILIZING DEVICE

(75) Inventors: Russell P. Suor, Caledonia, MI (US); Valentino M. Villa, Milan (IT)

(73) Assignee: Stiles Machinery, Inc., Grand Rapids, MI (US)

( * ) Notice: Subject to any disclaimer, the term of this patent is extended or adjusted under 35 U.S.C. 154(b) by 287 days.

(21) Appl. No.: 12/169,440

(22) Filed: Jul. 8, 2008

(51) Int. Cl.
*B27L 5/04* (2006.01)
*B26D 1/14* (2006.01)

(52) U.S. Cl. ..... 144/363; 144/237; 83/481; 83/478

(58) Field of Classification Search ..... 144/231–235, 144/218, 176, 162.1, 2.1, 222, 223, 237, 144/238, 239, 363; 83/425.3, 425.4, 508.3, 83/826, 447, 618, 620, 859, 860, 469, 508.2; 30/388–391; 248/680, 681
See application file for complete search history.

(56) References Cited

U.S. PATENT DOCUMENTS 3,645,304 A * 2/1972 Thrasher ..... 83/821
3,750,503 A * 8/1973 McMillan ..... 83/16
3,772,956 A * 11/1973 McMillan ..... 83/827
4,041,823 A * 8/1977 Ashbrook ..... 83/478
4,161,898 A * 7/1979 Wingen ..... 83/171
4,741,234 A * 5/1988 Colombo ..... 83/481
5,131,304 A * 7/1992 Paavola ..... 83/478
5,237,900 A * 8/1993 Supe-Dienes et al. ..... 83/563
5,370,026 A * 12/1994 Cavagna ..... 83/478
5,775,193 A * 7/1998 Pratt ..... 83/659
6,463,838 B2 * 10/2002 Hsu ..... 83/481
6,868,766 B1 * 3/2005 Sellers et al. ..... 83/481
7,134,372 B2 * 11/2006 Flaherty et al. ..... 83/425.4

* cited by examiner

*Primary Examiner* — Dana Ross
*Assistant Examiner* — Jennifer Chiang
(74) *Attorney, Agent, or Firm* — Price, Heneveld, Cooper DeWitt & Litton LLP

(57) ABSTRACT

One aspect of the present invention includes a ripsaw stabilizing device that has a moveable carrier arm subassembly, a hold-down subassembly, a hold-down support engaged to the moveable carrier arm subassembly and a force applying subassembly engaged to the hold-down subassembly and the hold-down support that applies downward force such that downward force is applied to a piece of material being cut on both sides of the blade. Another aspect of the present invention includes a method for making a glue-line quality cut without further processing of the material being cut and without the use of a sacrificial material. Yet another aspect of the present invention includes a ripsaw including one or more ripsaw stabilizing devices of the present invention.

20 Claims, 4 Drawing Sheets

RIPSAW STABILIZING DEVICE

BACKGROUND OF THE INVENTION

The present invention generally relates to a ripsaw stabilizing bar and a method for creating a glue-line quality ripsaw cut. In order to maintain an accurate straight line cut through a ripsaw the product, typically lumber, must be held tightly as it passes through the ripsaw. This process can be a challenge due to the fact that as the product is cut, there is a natural relief of the stresses in the product, typically wood, that causes the wood to bend and move or otherwise actuate away or into the saw blade(s). This causes the wood edges to be shaved by the saw blades or to be cut inaccurately. As a result, the cut product exhibits non-flat edges that have to be planed in a wood or other product planer or moulder to make a smooth glue-line cut.

Currently, ripsaw manufacturers either reluctantly tolerate these jagged ripsawed cuts or typically use some sort of sacrificial material in the area of the saw blades to apply downward force to prevent the wood from bending in the area of the saw blades. However, since this material is repeatedly cut by the saw blade(s) of the ripsaw, it inevitably deteriorates and loses functionality as a means to apply force to the wood. The sacrificed material must be periodically replaced, requiring large amounts of down time for the ripsaw.

SUMMARY OF THE INVENTION

The present invention generally relates to a ripsaw stabilizing device that allows the complete system employing the device to cut a glue line quality cut(s) when used in connection with a ripsaw. A glue line quality cut is generally any cut that, when two cut pieces are glued together is so smooth and so straight as to not have a gap, in general this means that the hollow joint gap at mid-length of two freshly sawed forty inch long pieces is 0.005 inches or less, more preferably 0.004 inches or less. In an embodiment of the present invention this is achieved by minimizing the transition area from the upper pressure rollers of the ripsaw that carry the work before and after the wood passes through the blade to the ripsaw stabilizing device, which provides downward pressure on the wood while it is being cut. Both the force from the rollers and the force from the ripsaw stabilizing device stabilize the wood. As a result, the cut made by the saw blade(s) of the ripsaw is glue-line quality without down time for replacement of disposable materials and/or the need to further process the wood, such as being planed in a planer or moulder.

One aspect of the present invention includes a ripsaw stabilizing device that has a moveable carrier arm subassembly, a hold-down subassembly, a hold-down support engaged to the moveable carrier arm subassembly and a force applying subassembly engaged to the hold-down subassembly and the hold-down support that applies downward force such that downward force is applied to a piece of material being cut on both sides of the blade as the material travels through the saw. Another aspect of the present invention includes a method for making a glue-line quality cut without further processing of the material being cut and without the use of a sacrificial hold-down material. Yet another aspect of the present invention includes a ripsaw including one or more ripsaw stabilizing devices of the present invention.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
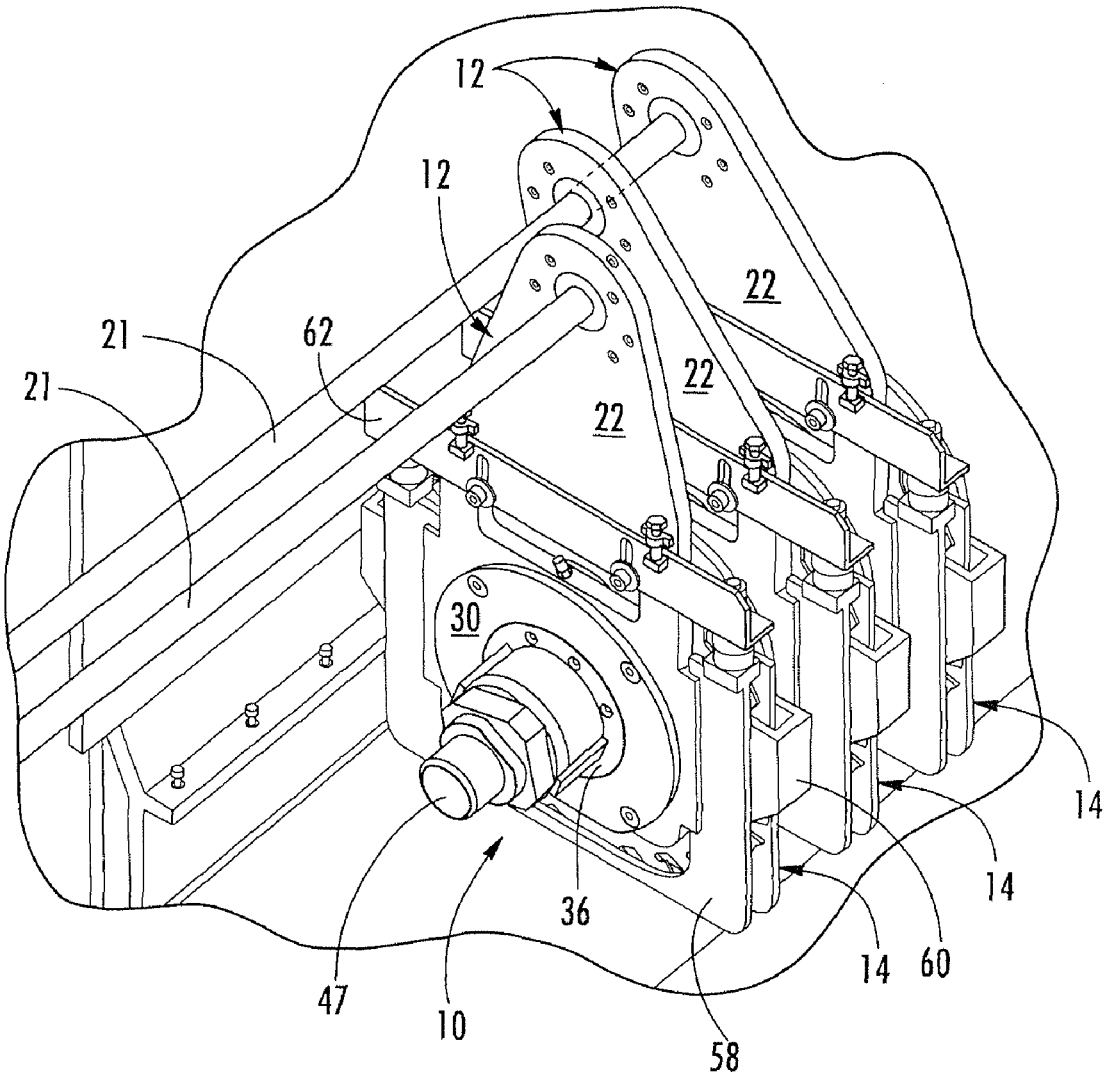
FIG. 1 is a perspective view of a plurality of ripsaw stabilizing devices of the present invention in a multi-blade ripsaw stabilizing device.

The present invention generally relates to a ripsaw stabilizing device 10 that generally includes a moveable carrier arm subassembly 12, a hold-down subassembly 14 and a force applying subassembly 16.

The moveable carrier arm subassembly 12 of the ripsaw stabilizing device 10 typically includes an aperture 20 for attachment of the moveable carrier arm 22 to a servo arm 21 of the ripsaw. A ripsaw may include multiple ripsaw stabilizing devices and their accompanying ripsaw blades mounted on one or more servo arms. The use of multiple servo arms allows for independent movement of multiple blades to minimize waste in cutting wood. The blades can be positioned independently to, for example, cut out imperfections in the wood such as knots, wane, splits, pitch pockets or bark pockets. The servo arm may be controlled by a computer linked to one or more other computers or a computer network for adjusting the location of the cut by the saw blade of the ripsaw. Jack screws 24 are used to adjust the angle of the bottom surface 25 of the entire ripsaw stabilizing device. This allows for fine adjustments to the angle of the entire ripsaw stabilizing device and facilitates proper alignment with the feed surface of the ripsaw that carries the wood. This allows the operator to, if desired, ensure that the device is at least substantially if not exactly parallel with the surface carrying the incoming material (wood) to be cut by the blade. The moveable carrier arm 22 carries the hold-down subassembly 14 in a channel 26 along its substantially parallel downwardly extending sides 28. The channel 26 on the moveable carrier arm 22 allows for vertical movement and allows movement laterally of the entire hold-down device on the saw blade shaft to adjust to different cut dimensions. The upper portion 27 of the moveable carrier arm may be of multiple shapes to facilitate mounting on multiple servo arms 21 in a manner that allows for independent movement of the ripsaw stabilizing device(s) mounted on different servo arms. Each servo arm 21 may be engaged to multiple ripsaw stabilizing devices. A computer or operator may adjust the location of from typically 2-4, 5 or 6 blades. In this manner, maximum efficiency in avoiding waste materials (e.g. avoiding and cutting out knotted portions of the lumber, wane, splits, pitch pockets or bark pockets being cut) may be obtained. The upper portion of the moveable carrier arm 22 is typically about 15 mm thick. Jack screws 86 and lock bolts 74 are used (in conjunction with locknuts 88) to adjust the angle of the bottom surface 25 of the entire ripsaw stabilizing device.

Figure 2:
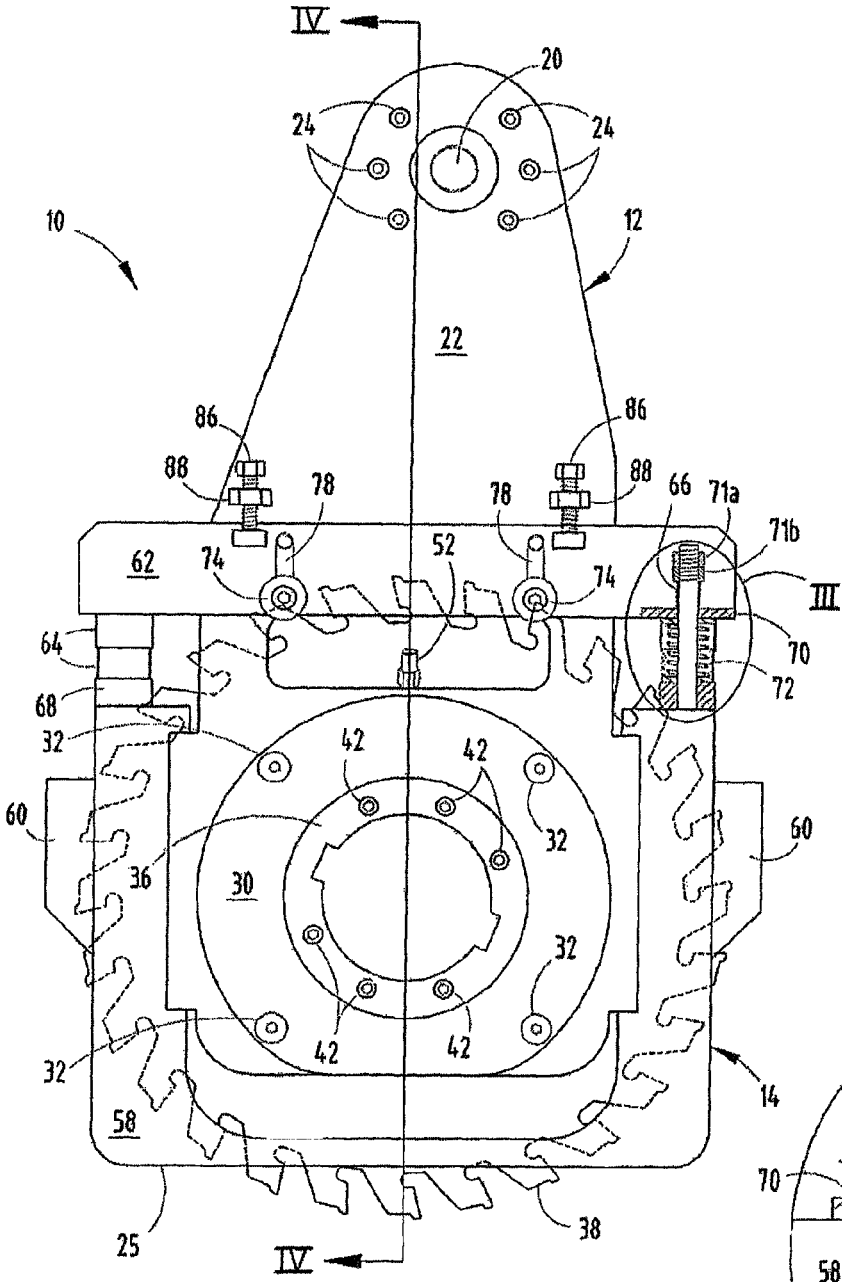
FIG. 2 is a rear side view of a ripsaw stabilizing device of the present invention.
Figure 6:
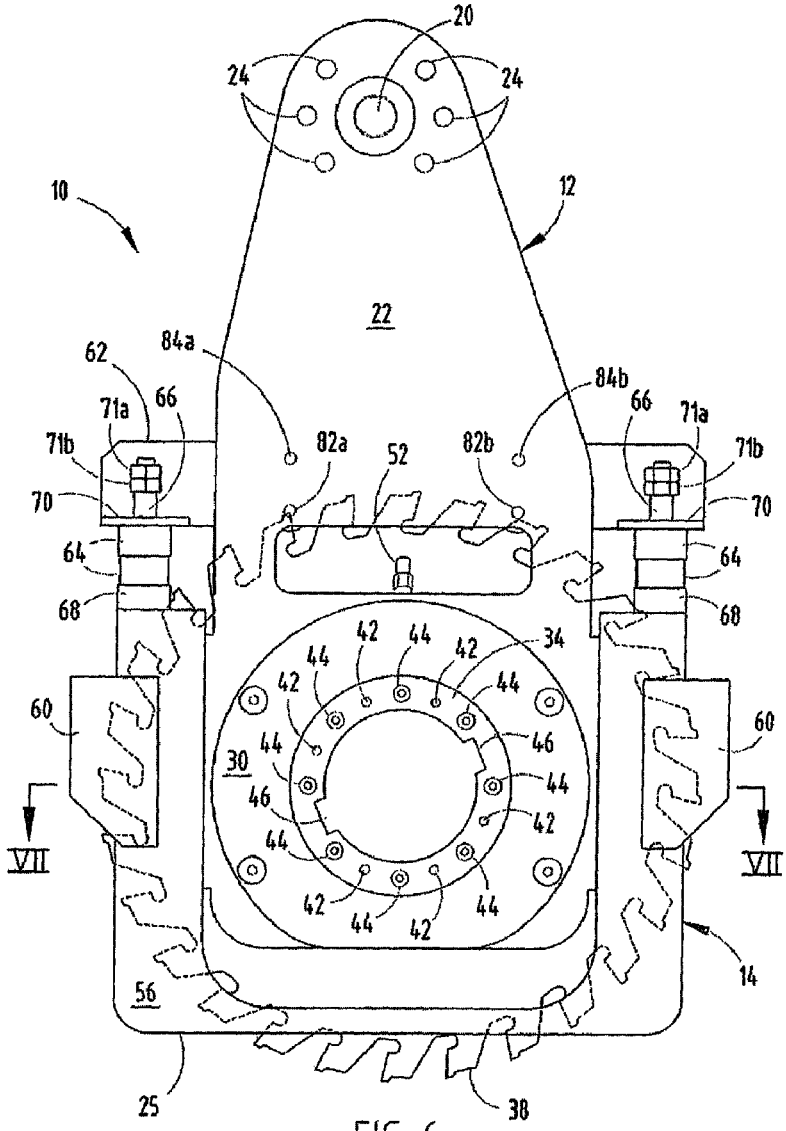
FIG. 6 is a front/blade side view of a ripsaw stabilizing device according to the present invention.

The moveable carrier arm further includes a bushing and bearing retaining plate 30 engaged to the moveable carrier arm on both sides. Typically the bushing and bearing retaining plates are engaged to the carrier arm 22 using plate bolts 32. The bushing and bearing retaining plates 30 retain the blade side bushing 34 and the rear side bushing 36 in position in the carrier arm 22. The bushing on the blade side is typically about 66% of the total thickness of the blade side and the rear side bushings. The additional dimension of the blade side bushing is utilized to carry the blade 38. The amount of the bushing holding the bearings 40 is typically the same on each side or approximately the same on each side. The bushings are typically retained using bushing bolts 42 positioned around the bushings as shown in FIGS. 2 and 6. The blade side of the bushing (FIG. 6) further includes blade mounting apertures 44 for engaging the blade to the bushing(s). The blade mounting apertures are typically evenly spaced about the circumference as shown in FIG. 6. The blade side bushing further includes a flange that facilitates centric installation of blade 38. The shaft is positioned through the center of the double key-wayed bushing 46 and mates with one another to facilitate centric mounting of the blade. The shaft 47 of the ripsaw typically contains the male side of the double key-wayed bearing and facilitates the centric mounting of the blade as discussed above.

Figure 4:
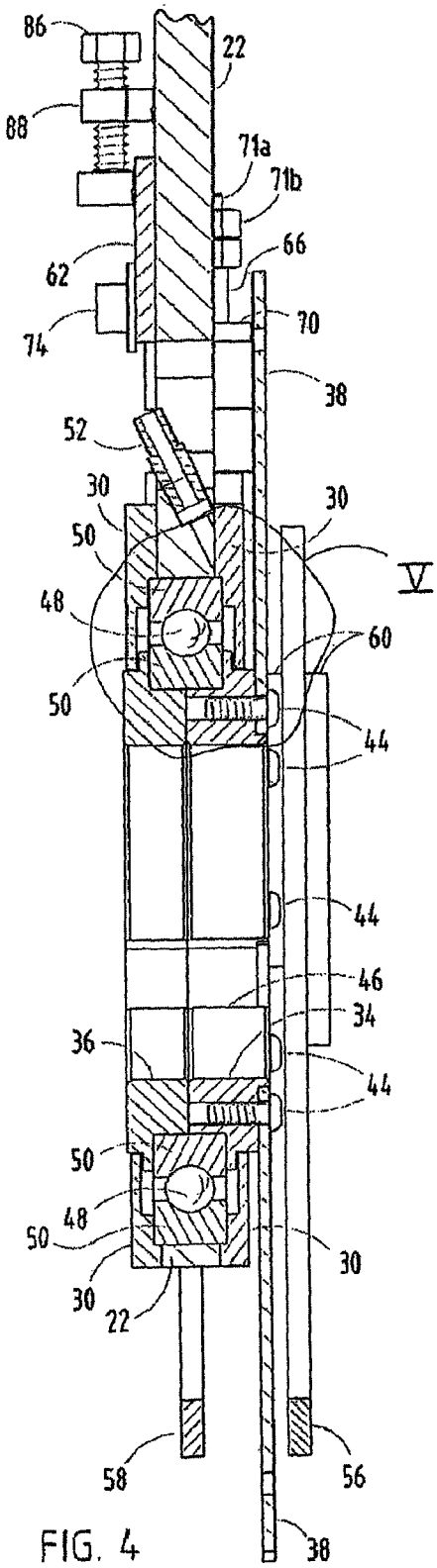
FIG. 4 is a cross-section of the ripsaw stabilizing device shown in FIG. 2 taken along the lines IV-IV shown in FIG. 2.
Figure 5:
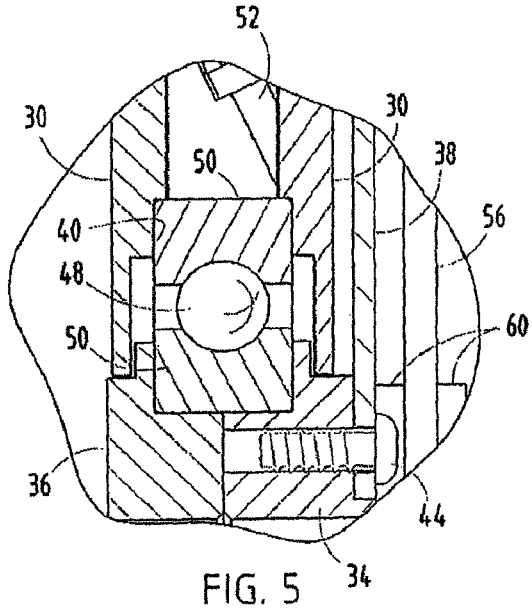
FIG. 5 is an enlarged view of the portion V shown in the cross-sectional view of FIG. 4.
Figure 7:
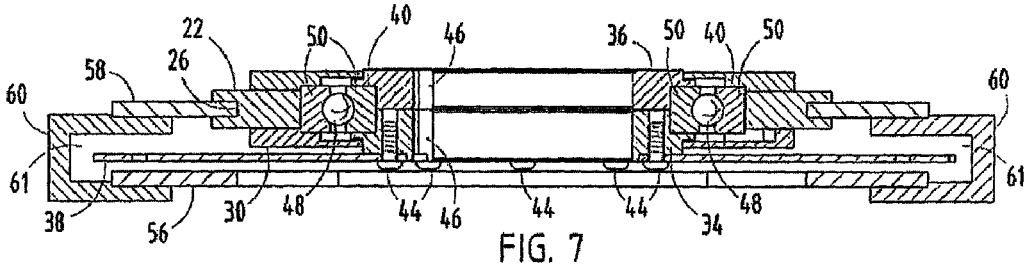
FIG. 7 is a cross-sectional view along the line VII-VII shown in FIG. 6.

The bearing 48 and races 50 are shown in FIGS. 4, 5, and 7. The bearings are typically greased using a zert fitting 52 which allows for the transmission of grease through a grease passage 54. The grease lubricates the bearings with the races.

The blade side bushing and rear side bushing are typically made of brass or other metal softer than steel. The bushings are preferably produced from brass because the brass will wear out prior to the steel components of the main portion of the ripsaw stabilizing device. As a result, the bushings wear and the remainder of the ripsaw stabilizing device has a long life. The bushings are less expensive than the entire hold-down device and more easily replaceable than an entire hold-down device.

The hold-down assembly 14 of the ripsaw stabilizing device generally includes a front, blade side generally U-shaped hold-down bracket 56 and a rear side generally U-shaped hold-down bracket 58. The front/blade side generally U-shaped hold-down bracket 56 and the rear side generally U-shaped hold-down bracket 58 are adjoined by a generally C-shaped channel forming bracket 60. The generally U-shaped hold-down brackets and the C-shaped channel forming brackets are typically engaged to one another or held together at each connection point by one or more welds. As shown in FIG. 7, in a preferred embodiment, the rear side generally U-shaped hold-down bracket 58 is mounted to the outside portion of the C-shaped channel forming bracket 60 while the blade side generally U-shaped hold-down bracket 56 is engaged to the interior of the C-shaped channel forming bracket 60. Also shown in FIG. 7 is the channel space 61 formed by the generally U-shaped hold-down brackets and the C-shaped channel forming bracket. This channel space 61 is typically as narrow as possible, typically a dimension which provides adequate hold-down pressure to maintain a glue line quality cut while also providing space for the saw blade, while still allowing for free movement of the blade residing within the channel. The channel is typically about 22 mm across from the inside surface of each generally U-shaped hold-down bracket.

The assembly formed by the generally U-shaped hold-down brackets and the C-shaped channel forming bracket preferably engages the moveable carrier arm. Typically they are engaged using a hold-down support bar 62 with a force applying subassembly 16 therebetween.

Figure 3:
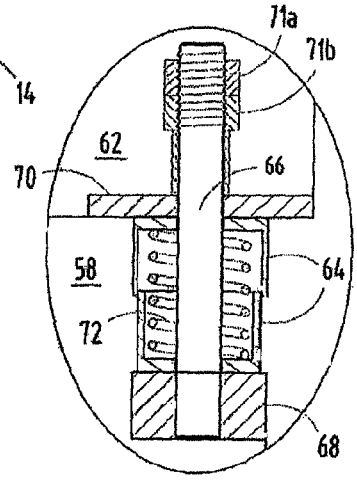
FIG. 3 is an enlarged view of the portion III shown in FIG. 2.

The force applying subassembly 16 typically engages the top surface or top portion of the rear side generally U-shaped hold-down bracket 58. This attachment is generally shown in FIGS. 2 and 3. As shown in FIG. 3, a force applying subassembly according to an embodiment of the present invention includes two spring retainer cups 64. A typically threaded stud 66 is engaged to the rear side generally U-shaped hold-down bracket 58 via a weld utilizing steel plate 68. The threaded stud extends up through steel ledge 70 on the front side portion of the hold-down support bar 62. Two nuts 71*a* and 71*b* are typically utilized on the threaded end portion of the stud for fine adjustment of the amount of force when a spring biasing device is utilized. It is presently contemplated that a pneumatic force applying subassembly could also be used. The pneumatic device would allow for force adjustment from outside of the overall ripsaw. Such a system would not require use of the threaded stud 66. The spring 72 is shown is a helical spring. However, the spring could also be in the form of cupped washers, generally referred to as a Belleville spring. Belleville springs have less movement and hold their tensile strength longer than helical springs. A Belleville spring utilizes a series of slightly conical shaped washers stacked on top of one another in an alternating direction/orientation.

The hold-down support bar 62 is typically engaged to the moveable carrier arm via support bar bolts 74 and washers 76. The location of the support bar bolts 74 can be varied along height adjustment channels 78. The support bar bolts may be positioned in one of one or more pairs of apertures (82 *a,b* or 84 *a,b*) (see FIG. 6) in the moveable carrier arm 22. Two such positions are shown in the drawing in this application, but conceivably any number of pairs of apertures could be utilized. The height adjustment channels 78 in the hold-down support bar 62 are utilized to adjust the height of the bottom surface 25 depending upon the type and thickness of material (wood) being cut. Typically the device is positioned such that the bottom surface 25 hangs about 3 mm below the height of the wood or other material. Also, jack screws 86 can be mounted through an L-shaped bracket 88 that is engaged to the moveable carrier arm 22 as shown in, for example, FIG. 2. The L-shaped bracket can be welded to the carrier arm in a manner that allows the jack screw to mate with a receiving bracket 90 having an aperture for receiving the jack screw. This allows for fine adjustment of the hold-down as needed for desired tension and alignment.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A ripsaw stabilizing device for applying downward force to a piece of material to be cut by a ripsaw on both sides of the a circular saw blade having teeth comprising:

a moveable carrier arm subassembly, a hold-down subassembly, a hold down support engaged to the moveable carrier arm assembly, and a force applying subassembly engaged to the hold-down subassembly and the hold down support;

wherein the moveable carrier arm subassembly comprises:

a carrier arm comprising an upper portion having an aperture for attachment to a carrier arm of a saw and a lower portion having two substantially parallel sides wherein each side comprises a hold-down subassembly engaging channel that receives a component of the hold down subassembly and allows for movement of the hold down subassembly;

wherein the hold-down subassembly comprises a blade side generally U-shaped bracket and a rear side generally U-shaped bracket engaged to one another via a channel forming apparatus such that the space between the blade side bracket and the rear side bracket defines a channel space for carrying the saw blade with each bracket on opposite sides of the saw blade, and wherein both generally U-shaped brackets have two upwardly extending sides and a bottom portion connecting the two upwardly extending sides and extending therebetween and the rear side generally U-shaped bracket engages the hold-down subassembly engaging channel of the carrier arm and thereby receives the hold down subassembly;

wherein the force applying subassembly comprises a force applying mechanism engaged to a top portion of each of the upwardly extending sides of the generally U-shaped brackets and engaged to the hold down support and capable of causing a downward force to be applied by the generally U-shaped brackets to a face of material to be cut on both sides of the circular blade, wherein the hold down support is also engaged to the upper portion of the carrier arm.

2. The ripsaw stabilizing device of claim 1, wherein the moveable carrier arm subassembly further comprises bushing and bearing retaining plates on opposite sides of the carrier arm that retain a blade side bushing and a rear side bushing in position in the carrier arm; and wherein the hold-down subassembly engaging channel that receives the hold-down subassembly allows for vertical movement of the hold-down subassembly when the ripsaw stabilizing device is in an operating position.

3. The ripsaw stabilizing device of claim 2, wherein the blade side bushing is about 66% of the total thickness of the blade side and rear side bushings together while the amount of the blade side and rear side bushings that retain the bearings is the same or approximately the same on each side and wherein the blade side bushing comprises blade mounting apertures for engaging the blade to the bushings and wherein the bushings are double key-wayed.

4. The ripsaw stabilizing device of claim 3, wherein the carrier arm further comprises a zert fitting engaged to the carrier arm above the bushings and operably connected to a grease transmission channel that allows grease to pass through the zert fitting and the grease transmission channel to lubricate a plurality of bearings within bushings.

5. The ripsaw stabilizing device of claim 4, wherein the generally U-shaped brackets each comprise an outer surface and an inner channel space facing surface and the channel forming apparatus comprises a generally C-shaped bracket wherein the generally C-shaped bracket engages the rear side generally U-shaped bracket on its outside surface and the generally C-shaped bracket engages the channel space facing surface of the blade side generally U-shaped bracket.

6. The ripsaw stabilizing device of claim 5, wherein the generally U-shaped brackets have the same shape along their perimeter and the upwardly extending sides are wider than the bottom portion.

7. The ripsaw stabilizing device of claim 5, wherein the hold down support comprises a hold down support bar having two ledges extending at about 90 degrees from hold down support bar at each end of the bar on the same side of the support bar and wherein the two ledges each have an aperture therein and wherein the rear side generally U-shaped hold-down bracket further comprises a cap section at the top of each upwardly extending side of the bracket and an upwardly extending threaded stud engaged to each cap section that extends through the apertures in the ledges to engage the hold down subassembly and the force applying subassembly.

8. The ripsaw stabilizing device of claim 7, wherein the cap section is a steel plate forming a T-shaped configuration at the top of the rear side generally U-shaped hold-down bracket.

9. The ripsaw stabilizing device of claim 7, wherein the hold down support bar further comprises at least two height adjustment channels that are oriented substantially perpendicular with a surface of a material to be cut by the ripsaw blade of the device and wherein the moveable carrier arm comprises support bar apertures such that when a support bar bolt is positioned within the support bar apertures and the height adjustment channels the height of the hold-down subassembly may be adjusted and thereby the hold-down subassembly held in position by tightening a nut to the support bar bolts until the force is sufficient to retain the elements in position.

10. The ripsaw stabilizing device of claim 9 further comprising at least two jack screws operably connected to the carrier arm and the hold down support bar for fine height adjustment of the hold-down subassembly.

11. The ripsaw stabilizing device of claim 1, wherein the force applying mechanism comprises mechanisms for applying downward force chosen from the group consisting of a coil spring, a Belleville spring, and a pneumatic cylinder.

12. The ripsaw stabilizing device of claim 1, wherein the force applying mechanism comprises at least two springs wherein a spring in positioned proximate the top of both upwardly extending sides of each the blade side bracket and the rear side bracket such that the upwardly extending sides receive a downward force from the force applying mechanism.

13. The ripsaw stabilizing device of claim 1 further comprising at least two jack screws operably connected to the carrier arm and the hold down support for fine height adjustment of the hold-down subassembly.

14. The ripsaw stabilizing device of claim 1, wherein generally U-shaped hold down brackets comprises a generally planar bottom surface and the carrier arm comprises a plurality of jack screws mounted circumferentially about the aperture for attachment to a carrier arm of a saw to allow for adjustment of the pitch angle of the bottom surface of the generally U-shaped carrier brackets.

15. The ripsaw stabilizing device of claim 1, wherein the channel forming apparatus comprises a generally C-shaped bracket and wherein the ripsaw stabilizing device is substantially made of steel and further comprising a blade positioned within the channel space.

16. A ripsaw comprising:

a power source;

at least one moveable carrier arm operatively connected to the power source by a first laterally moveable arm where the first laterally moveable arm and at least one carrier arm are capable of being actuated utilizing the power source; and a first ripsaw stabilizing device engaged to a first moveable carrier arm wherein the first ripsaw stabilizing device applies downward force to a piece of material to be cut by a ripsaw on both sides of a circular saw blade with teeth and comprises:

a moveable carrier arm subassembly, a hold-down subassembly, a hold down support engaged to the moveable carrier arm subassembly, and a force applying subassembly engaged to the hold-down subassembly and the hold down support;

wherein the moveable carrier arm subassembly comprises: a carrier arm comprising an upper portion having a first shape and an aperture for attachment to the moveable carrier arm and a lower portion having two substantially parallel sides wherein each side comprises a hold-down subassembly engaging channel that receives a component of the hold down subassembly;

wherein the hold-down subassembly comprises a blade side generally U-shaped bracket and a rear side generally U-shaped bracket engaged to one another via a channel forming bracket such that the space between the blade side bracket and the rear side bracket defines a channel space for carrying a blade with each bracket on opposite sides of the blade, and wherein both generally U-shaped brackets have two upwardly extending sides and a bottom portion connecting the two upwardly extending sides and the rear side generally U-shaped bracket has an edge opposite the channel forming bracket on both upwardly extending sides of the U-shaped bracket that engages the hold-down subassembly engaging channel and thereby receives the hold down subassembly and allows for vertical movement of the hold-down subassembly when the ripsaw stabilizing device is in an operating position; wherein the force applying subassembly comprises a force applying mechanism engaged to a top portion of each of the upwardly extending sides of the generally U-shaped brackets and engaged to the hold-down support, wherein the hold down support is also engaged to the upper portion of the carrier arm.

17. The ripsaw of claim 16 further comprising a second ripsaw stabilizing device engaged to a second moveable carrier arm operably connected to a second laterally moveable arm wherein the second laterally moveable arm is independently moveable from the first laterally moveable arm wherein the second ripsaw stabilizing device comprises a moveable carrier arm subassembly, a hold-down subassembly, a hold-down support engaged to the moveable carrier arm subassembly, and a force applying subassembly engaged to the hold-down subassembly and the hold-down support;

wherein the moveable carrier arm subassembly comprises: a carrier arm comprising an upper portion having a second shape that is different from the first shape and allows independent movement of the first ripsaw stabilizing device and the second ripsaw stabilizing device thereby allowing independent adjustment of saw blades positioned within each ripsaw stabilizing device while maintaining a glue line quality cut at each location, and an aperture for attachment to the moveable carrier arm and a lower portion having two substantially parallel sides wherein each side comprises a hold-down subassembly engaging channel that receives a component of the hold down subassembly;

wherein the hold-down subassembly comprises a blade side generally U-shaped bracket and a rear side generally U-shaped bracket engaged to one another via a channel forming bracket such that the space between the blade side bracket and the rear side bracket defines a channel space for carrying a blade with each bracket on opposite sides of the blade and wherein both generally U-shaped brackets have two upwardly extending sides and a bottom portion connecting the two upwardly extending sides and the rear side generally U-shaped bracket has an edge opposite the channel forming bracket on both upwardly extending sides of the U-shaped bracket that engages the hold-down subassembly engaging channel and thereby receives the hold down subassembly and allows for vertical movement of the hold-down subassembly when the ripsaw stabilizing device is in an operating position;

wherein the force applying subassembly comprises a force applying mechanism engaged to the top portion of each of the upwardly extending sides of the generally U-shaped brackets and to the hold-down support, wherein the hold down support is also engaged to the upper portion of the carrier arm.

18. The ripsaw of claim 16 further comprising a second ripsaw stabilizing device engaged to the first moveable carrier arm wherein the second ripsaw stabilizing device comprises: a moveable carrier arm subassembly, a hold-down subassembly, a hold down support engaged to the moveable carrier arm subassembly, and a force applying subassembly engaged to the hold-down subassembly and the hold down support; wherein the moveable carrier arm subassembly comprises: a carrier arm comprising an upper portion having an aperture for attachment to the moveable carrier arm and a lower portion having two substantially parallel sides wherein each side comprises a hold-down subassembly engaging channel that receives a component of the hold down subassembly;

wherein the hold-down subassembly comprises a blade side generally U-shaped bracket and a rear side generally U-shaped bracket engaged to one another via a channel forming bracket such that the space between the blade side bracket and the rear side bracket defines a channel space for carrying a blade with each bracket on opposite sides of the blade and wherein both generally U-shaped brackets have two upwardly extending sides and a bottom portion connecting the two upwardly extending sides and the rear side generally U-shaped bracket has an edge opposite the channel forming bracket on both upwardly extending sides of the U-shaped bracket that engages the hold-down subassembly engaging channel and thereby receives the hold down subassembly and allows for vertical movement of the hold-down subassembly when the ripsaw stabilizing device is in an operating position;

wherein the force applying subassembly comprises a force applying mechanism engaged to the top portion of each of the upwardly extending sides of the generally U-shaped brackets and to the hold-down support, wherein the hold down support is also engaged to the upper portion of the carrier arm.

19. A method of making a glue-line quality cut using a ripsaw comprising the steps of: providing (1) a wood material to be cut having a first cut side and a second cut side on opposite sides of where a blade cuts the wood; and (2) a ripsaw comprising a power source, at least one moveable carrier arm actuated utilizing the power source, and a first ripsaw stabilizing device engaged to a first carrier arm wherein the first ripsaw stabilizing device applies downward force to a piece of material to be cut by a ripsaw on both sides of the blade a saw blade having teeth wherein the first ripsaw stabilizing device comprises:

a moveable carrier arm subassembly, a hold-down subassembly, a hold down support engaged to the moveable carrier arm subassembly, and a force applying subassembly engaged to the hold-down subassembly and the hold down support;

wherein the moveable carrier arm subassembly comprises:

a carrier arm comprising an upper portion having a first shape and an aperture for attachment to the moveable carrier arm and a lower portion having two substantially parallel sides wherein each side comprises a hold-down subassembly engaging channel that receives the hold down subassembly;

wherein the hold-down subassembly comprises a blade side generally U-shaped bracket and a rear side generally U-shaped bracket engaged to one another via a channel forming bracket such that the space between the blade side bracket and the rear side bracket defines a channel space for carrying a blade with each bracket on opposite sides of the blade and wherein both generally U-shaped brackets have two upwardly extending sides and a bottom portion connecting the two upwardly extending sides and the rear side generally U-shaped bracket has an edge opposite the channel forming bracket on both upwardly extending sides of the U-shaped bracket that engages the hold-down subassembly engaging channel and thereby receives the hold down subassembly and allows for vertical movement of the hold-down subassembly when the ripsaw stabilizing device is in an operating position;

wherein the force applying subassembly comprises a force applying mechanism engaged to a top portion of each of the upwardly extending sides of the generally U-shaped brackets and to the hold-down support; and feeding the wood material to be cut through the ripsaw such that the ripsaw stabilizing device applies downward force to both the first cut side and the second cut side thereby making a glue-line quality cut without further processing of the wood material.

20. The method of claim 19, wherein the ripsaw further comprises a second ripsaw stabilizing device engaged to a second moveable carrier arm and carrying a second saw blade wherein the second ripsaw stabilizing device is capable of movement independent from the first ripsaw stabilizing device and comprises a moveable carrier arm subassembly, a hold-down subassembly, a hold down support engaged to the moveable carrier arm subassembly, and a force applying subassembly engaged to the hold-down subassembly and the hold down support;

wherein the moveable carrier arm subassembly comprises:

a carrier arm comprising an upper portion having a first shape and an aperture for attachment to the moveable carrier arm and a lower portion having two substantially parallel sides wherein each side comprises a hold-down subassembly engaging channel that receives a component of the hold down subassembly;

wherein the hold-down subassembly comprises a blade side generally U-shaped bracket and a rear side generally U-shaped bracket engaged to one another via a channel forming bracket such that the space between the blade side bracket and the rear side bracket defines a channel space for carrying a blade with each bracket on opposite sides of the blade and wherein both generally U-shaped brackets have two upwardly extending sides and a bottom portion connecting the two upwardly extending sides and the rear side generally U-shaped bracket has an edge opposite the channel forming bracket on both upwardly extending sides of the U-shaped bracket that engages the hold-down subassembly engaging channel and thereby receives the hold down subassembly and allows for vertical movement of the hold-down subassembly when the ripsaw stabilizing device is in an operating position;

wherein the force applying subassembly comprises a force applying mechanism engaged to the top portion of each of the upwardly extending sides of the generally U-shaped brackets and to the hold-down support.

* * * * *

UNITED STATES PATENT AND TRADEMARK OFFICE

CERTIFICATE OF CORRECTION

PATENT NO. : 7,992,604 B1
APPLICATION NO. : 12/169440
DATED : August 9, 2011
INVENTOR(S) : Suor et al.

It is certified that error appears in the above-identified patent and that said Letters Patent is hereby corrected as shown below:

In the Claims

Column 4, claim 1, lines 60-61, "of the a circular" should be --of a circular--;

Column 7, claim 16, line 29, after "position;" insert a return;

Column 8, claim 19, line 60, "of the blade a saw blade" should be --of a saw blade--;

Column 9, claim 19, line 27, "support; and feeding" should be --support; and [return] feeding--.

Signed and Sealed this
Twenty-eighth Day of January, 2014

Michelle K. Lee

Michelle K. Lee
*Deputy Director of the United States Patent and Trademark Office*